US005353706A

United States Patent [19]

Kerle

[11] Patent Number: 5,353,706

[45] Date of Patent: Oct. 11, 1994

[54] METHOD OF PRINTING ON NATURAL FIBER FABRICS USING A RESIN-FREE VARNISH

[76] Inventor: Thomas Kerle, Plauener Strasse 4, 8510 Furth/Bayern BR, Fed. Rep. of Germany

[21] Appl. No.: 922,154

[22] Filed: Jul. 30, 1992

[30] Foreign Application Priority Data

Aug. 7, 1991 [DE] Fed. Rep. of Germany ..... 4126096

[51] Int. Cl.[5] ..... B41F 1/16

[52] U.S. Cl. ..... 101/492; 101/170

[58] Field of Search ..... 101/470, 473, 170, 492; 8/470, 471; 427/323, 324, 384

[56] References Cited

U.S. PATENT DOCUMENTS 4,210,412 7/1980 Yamane et al. ..... 101/470

4,510,008 4/1985 Hoshi et al. ..... 156/269

*Primary Examiner*—Edgar S. Burr

*Assistant Examiner*—Ren Yan

*Attorney, Agent, or Firm*—Robin, Blecker, Daley & Driscoll

[57] ABSTRACT

The invention relates to a method for printing on woven fabrics of natural fibers or of woven fabrics with a predominantly natural fiber component of cotton, wool, silk, linen, and the like, by means of a transfer printing method, with the woven fabrics being materials, the surfaces of which do not demonstrate sufficient inherent affinity for the dyes to be transferred from the transfer paper to the substrate, where the woven fabric surface to be printed on is first pretreated in such a manner that transparent varnish is applied to these surfaces, where the varnish is a varnish which is at least free of natural resins, which, after it dries, can absorb and fix the sublimable dye or dyes of the transfer paper during a subsequent transfer printing process.

11 Claims, No Drawings

METHOD OF PRINTING ON NATURAL FIBER FABRICS USING A RESIN-FREE VARNISH

FIELD OF THE INVENTION

The invention relates to a method for printing on woven fabrics of natural fibers or of woven fabrics with a predominantly natural fiber component.

BACKGROUND OF THE INVENTION

Transfer printing methods or thermal printing methods are described in detail in the following technical information bulletins of the company Michael Huber GmbH:

1. Technical Information Bulletin No. 40.02 dated August 1989, "Transferdruck—Allgemeine Verfahrensbeschreibung" ["Transfer Printing—General Description of the Process"];
2. Technical Information Bulletin No. 40.05 dated August 1989: "Transferdruck—Transferfarben fÜr den Bogenoffsetdruck" ["Transfer Printing—Transfer Inks for Sheet Offset Printing"]; and
3. Technical Information Bulletin No. 40.06.-1-40-06-7 dated October 1989: "Transferdruck auf Baumwolle" ["Transfer Printing on Cotton"].

The transfer printing method essentially consists of printing inks with sublimable dyes first onto paper, and then transferring only the dyes onto textiles or other substrates during the subsequent transfer printing process, by applying heat. Instead of paper, another suitable material can also be used, if desired.

In the technical information bulletin No. 40.01, August 1989, of the company Michael HÜber München GmbH, it is explained in detail in the section "Area of Use" that the sublimable dye applied to the paper with the ink changes directly from the solid to the gas state (sublimation) during the subsequent transfer process, at predetermined transfer temperatures between 190° and 220° C., for example, and is present in the monomolecular state. Transfer printing works on substrates of certain materials, which permit penetration of the dye molecules into their own molecular structure and already fix the dye there during transfer, due to the fact that they themselves are also heated during the transfer process. Materials of this type include primarily synthetic fibers, particularly fibers of polyester, polyamides, polyacrylic nitrile and triacetate.

In contrast, substrates such as woven fabrics of natural fibers or a predominantly natural fiber component inherently do not have sufficient affinity for the dyes to be transferred to the substrate from the transfer paper.

Materials, the surface of which does not have sufficient affinity from the dye, also include glass, porcelain, plastic or wood, for example.

In the technical information bulletin No. 40.05 of the company Michael Huber MÜnchen GmbH, dated October 1989, it is pointed out in the section "Substrates for Transfer Printing" that woven fabrics of natural fibers (cotton, wool, silk, linen) or with a predominantly natural fiber component, as well as woven fabrics of regenerated cellulose fibers, cannot be printed on by means of transfer printing, or can only be printed on after suitable pretreatment. The technical information bulletin No. 40.06-2 of the company Michael Huber MÜnchen GmbH, dated October 1989, "Transfer Printing On Cotton," explains in detail, that a formulation which contains primarily resin and some other components can be used for pretreatment of woven fabrics made of cotton.

The woven fabric is pretreated with such a formulation and then dried, so that it is prepared for a subsequent transfer printing process.

In the practical application of fabrics of cotton or cotton mixtures which have been pretreated and printed as explained above, it has proven to be extremely disadvantageous, however, that the resin seals the woven fabric surfaces with a type of skin or film, so that the resulting woven fabric, i.e, the textile articles produced from this woven fabric, no longer breathes sufficiently, i.e. is no longer sufficiently permeable for air and perspiration. This has the consequence that the end products in the form of clothing articles, such as cotton T-shirts or similar articles, are no longer comfortable to wear.

SUMMARY OF THE INVENTION

The present invention has as its primary object the provision of a new and improved method for printing on substrates by means of the transfer printing method, where it is assumed that these substrates consist of materials, the surfaces of which do not demonstrate sufficient inherent affinity for the dyes to be transferred from the transfer paper to the substrate.

Taking this into consideration, process steps are sought which specifically permit printing onto substrates of the aforementioned type, using transfer printing methods.

In particular, the invention seeks a new way in view of the difficulties in printing on woven fabrics made of natural fibers, or with a predominantly natural fiber component, which will result in satisfactory wearing comfort, i.e., satisfactory breathing activity of the resulting clothing articles, in particular.

DESCRIPTION OF PREFERRED PRACTICES

The method according to the invention relates to the sector either of printing individual textile articles or printing textile yard goods. Printing individual textile articles means printing on finished textile products, such as T-shirts, yard goods printing refers to printing on rolls and bolts of textile products, the surfaces of which do not demonstrate sufficient inherent affinity to absorb dyes, particularly from transfer paper.

As a result of the application, according to the invention, of transparent varnish without significant resin components, i.e. without a significant proportion of natural resins, surfaces are created which are now entirely suitable for printing on by means of transfer printing methods.

When mention is made here of varnishes which are free of natural resins, this includes all known natural resins which would tend to glue the region of textile material together, or to occlude it in such a way that a layer which more or less covers the area between the individual woven fabric threads and occludes the woven fabric obtained. Surprisingly, it has been found that varnishes without a significant proportion of natural resin tend to absorb the dyes, they lay themselves exclusively around the woven fabric threads, more or less sealing the woven fabric fibers, but keep the pores between warp and weft of the woven fabric open. The woven fabric retains its textile "feel," the breathing activity of the woven fabric or article of clothing is retained, the resin effect on the material, which would not only lead to reduced breathing activity of the article of clothing, but also makes the article of clothing stiff and unattractive, is avoided.

The invention assumes at the outset that some proportion of synthetic resins will not have a negative influence on the desired positive effect of the method. However, varnishes which are entirely free of resins can also be used and such varnishes are commercially available and known.

Under some circumstances, it is also advantageous to use so-called ormocer varnishes. Ormocers are so called "ORganically MOdified CERamics" which were developed by the Frauenhofer society and represent a new class of substances which can be classified between inorganic and organic polymers. Ormocers are produced via the sol-gel process, by means of targeted hydrolysis and condensation of alcoxides, predominantly silicon, aluminum, titanium and zirconium alcoxides.

It is particularly advantageous if the varnish is briefly dried or at least partly dried to a great extent, after it has been applied, by means of heat action. It is advantageous if varnishes on a water-soluble basis are used, and excess water components are removed from the varnish layer by the drying or intermediate drying process, so that the varnish can better absorb the dyes which are subsequently applied.

The varnishes in accordance with the invention are defined as being particularly suitable for implementing the method according to the invention and can be classified in the group of varnishes with little negative environmental impact, but surprisingly possess properties which permit a large number of washing and cleaning processes of the woven fabric articles printed according to the invention, without any visible impairment of the textile feel or the quality of the printed picture. Tests of textile articles printed according to the invention, carried out by independent institutes, showed that on the basis of a scale from 0 (extremely poor values)–8 (extremely good values which are seldom achieved), it was relatively easy to achieve color permanence values between 5 and 7 with the printing method according to the invention. With this, the method according to the invention is distinguished from the state of the art not only by the fact that it guarantees the textile character, wearing comfort and comfort on the skin of the article of clothing, but also the permanence of the imprint on the textile article is far better than with most printing methods according to the state of the art, which are generally carried out on the basis of screen printing.

The invention is explained on the basis of an embodiment which is carried out as follows.

Varnish free of natural resins is applied to the surfaces of finished T-shirts consisting of cotton, which surfaces are to be printed on. This varnish is briefly partially dried immediately after it is applied, using a steam press. Then transfer printing paper can be placed onto the varnish section of the woven fabric, in the usual manner and this is placed onto usual offset printing paper for about 15–30 sec, and pressed on in a steam press at a temperature between 150° and 250° C.—depending on the printing paper and the woven fabric.

After the printing paper is pulled off, a color-intense imprint remains on the varnished surface in contrast to conventional methods, in which a pretreatment layer based on resin is applied, the feel of the printed textile segment does not differ from the "feel" of non-printed segments and the textile article has retained its uniform character.

In practicing the method of the invention, the varnish may be applied in several sequential steps and the varnish layer formed in each of the sequential steps may be dried prior to practice of the succeeding step. Further, the method of the invention may be practiced with continuous transfer printing and in such practice calendering may be included. Also, the method of the invention may be practiced with discontinuous transfer printing and in such practice, ironing-on printing may be effected.

What is claimed is:

1. A transfer print method for printing dyes on woven fabrics which do not demonstrate sufficient affinity for the dyes to be transferred to the fabric, said method comprising the steps of:

(a) selecting a transparent varnish which is at least free of natural resins; then (b) treating the fabric in such a manner that the transparent varnish is applied to surfaces of the fabric to which dye transfer is to be effected; and then (c) transfer printing the dye on the treated surfaces of the fabric.

2. The method claimed in claim 1, wherein the varnish is selected to be a resin-free varnish.

3. The method claimed in claim 2, wherein the varnish is selected to be a water-soluble varnish.

4. The method claimed in claim 1, wherein the varnish is selected to be a water-soluble varnish.

5. The method claimed in claim 1, wherein the varnish is selected to be an ormocer varnish.

6. The method claimed in claim 1 wherein the varnish is applied in several sequential steps in said treating step.

7. The method claimed in claim 6, wherein a varnish layer formed in each of said sequential steps is dried prior to practice of the succeeding step.

8. The method claimed in claim 1 wherein said transfer printing step is a continuous transfer printing step.

9. The method claimed in claim 8 wherein said continuous transfer printing step includes calendering.

10. The method claimed in claim 1 wherein said transfer printing step is a discontinuous transfer printing step.

11. The method claimed in claim 10 wherein said discontinuous transfer printing includes ironing-on printing.

* * * * *

UNITED STATES PATENT AND TRADEMARK OFFICE

CERTIFICATE OF CORRECTION

PATENT NO. : 5,353,706

DATED : October 11, 1994

INVENTOR(S) : Thomas Kerle

It is certified that error appears in the above-identified patent and that said Letters Patent is hereby corrected as shown below:

Col. 1, line 33. Change "HÜber" to -- Hüber --.

Col. 3, line 57. Change "manne-" to -- manner --.

Col. 4, line 1. Change "rand" to -- and --.

Col. 4, line 37. Change "2" to -- 1 --.

Col. 4, line 39. Change "1" to -- 2 --.

Signed and Sealed this

Seventeenth Day of January, 1995

*Attest:*

Bruce Lehman

BRUCE LEHMAN

*Attesting Officer*

*Commissioner of Patents and Trademarks*